US007905129B1

(12) United States Patent
Golovashchenko

(10) Patent No.: US 7,905,129 B1
(45) Date of Patent: Mar. 15, 2011

(54) METHOD AND TOOL FOR CONTRACTING TUBULAR MEMBERS BY ELECTRO-HYDRAULIC FORMING BEFORE HYDROFORMING

(75) Inventor: Sergey Fedorovich Golovashchenko, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/563,184

(22) Filed: Sep. 21, 2009

(51) Int. Cl.
*B21D 26/12* (2006.01)

(52) U.S. Cl. ..... 72/61; 72/62; 72/58; 29/419.2; 29/421.1

(58) Field of Classification Search ..... 72/54, 56, 72/57, 60, 61, 62; 29/419.2, 421.1, 421.2
See application file for complete search history.

(56) References Cited

U.S. PATENT DOCUMENTS

| | | | | |
|---|---|---|---|---|
| 1,542,983 | A | 6/1925 | Bergmann, Jr. | |
| 3,222,902 | A * | 12/1965 | Brejcha et al. | 72/56 |
| 3,253,442 | A | 5/1966 | Grove, Jr. et al. | |
| 3,273,365 | A | 9/1966 | Felts | |
| 3,338,080 | A | 8/1967 | Golden | |
| 3,348,402 | A | 10/1967 | Reistad | |
| 3,394,569 | A * | 7/1968 | Smith | 72/56 |
| 3,423,979 | A * | 1/1969 | May et al. | 72/56 |
| 3,434,194 | A * | 3/1969 | Whittaker et al. | 29/421.2 |
| 3,512,384 | A * | 5/1970 | Inoue | 72/56 |
| 3,555,866 | A * | 1/1971 | Roth | 72/56 |
| 3,572,072 | A | 3/1971 | Hundley et al. | |
| 3,575,631 | A | 4/1971 | Pratt | |
| 3,603,127 | A * | 9/1971 | Seiffert et al. | 72/56 |
| 3,688,535 | A | 9/1972 | Keinanen et al. | |
| 3,750,441 | A * | 8/1973 | Schneider et al. | 72/56 |
| 3,759,551 | A * | 9/1973 | Broske | 29/421.2 |
| 3,786,662 | A | 1/1974 | Roth | |
| 4,330,918 | A * | 5/1982 | Whitted, III | 72/56 |
| 5,611,230 | A * | 3/1997 | Chelluri et al. | 72/56 |
| 5,826,320 | A | 10/1998 | Rathke et al. | |
| 6,094,809 | A * | 8/2000 | Grassi | 29/419.2 |
| 6,591,649 | B1 * | 7/2003 | Gafri et al. | 72/56 |
| 6,766,678 | B1 | 7/2004 | Schulze et al. | |

(Continued)

FOREIGN PATENT DOCUMENTS

| | | |
|---|---|---|
| GB | 1068440 | 5/1967 |

(Continued)

OTHER PUBLICATIONS

V. Psyk, C. Beerwald, W. Homberg, M. Kleiner, Electromagnetic Compression as Preforming Operation for Tubular Hydroforming Parts, 1st International Conference on High Speed Forming—2004, Chair of Forming Technology, University of Dortmund, Germany, pp. 171-180.

*Primary Examiner* — David B Jones
(74) *Attorney, Agent, or Firm* — Raymond L. Coppiellie; Brooks Kushman P.C.

(57) ABSTRACT

A tubular preform is contracted in an electro-hydraulic forming operation. The tubular preform is wrapped with one or more coils of wire and placed in a chamber of an electro-hydraulic forming tool. The electro-hydraulic forming tool is discharged to form a compressed area on a portion of the tube. The tube is then placed in a hydroforming tool that expands the tubular preform to form a part.

15 Claims, 4 Drawing Sheets

U.S. PATENT DOCUMENTS

| | | | | |
|---|---|---|---|---|
| 6,875,964 | B2 | 4/2005 | Golovashchenko et al. | |
| 7,256,373 | B2 * | 8/2007 | Gafri et al. | 72/56 |
| 7,269,986 | B2 * | 9/2007 | Pfaffmann et al. | 72/60 |
| 7,395,597 | B2 * | 7/2008 | Shao et al. | 72/56 |
| 7,493,787 | B2 * | 2/2009 | Golovashchenko et al. | 72/63 |
| 2006/0107715 | A1 | 5/2006 | Imamura et al. | |

FOREIGN PATENT DOCUMENTS

| | | |
|---|---|---|
| GB | 1241343 | 8/1971 |
| GB | 1252997 | 11/1971 |

* cited by examiner

METHOD AND TOOL FOR CONTRACTING TUBULAR MEMBERS BY ELECTRO-HYDRAULIC FORMING BEFORE HYDROFORMING

STATEMENT REGARDING FEDERALLY SPONSORED RESEARCH OR DEVELOPMENT

This invention was made with U.S. Government support under Contract No. DE-FG36-08GO18128 awarded by the Department of Energy. The Government has certain rights in this invention.

BACKGROUND

1. Technical Field

The present invention relates to electro-hydraulic forming to contract a tubular member in a die.

2. Background Art

In electro-hydraulic forming ("EHF"), an electric arc discharge is used to convert electrical energy to mechanical energy. A capacitor bank, or other source of stored charge, delivers a high current pulse across two electrodes that are submerged in a fluid, such as oil or water. The electric arc discharge vaporizes some of the surrounding fluid and creates shock waves in the fluid. A workpiece that is in contact with the fluid may be deformed by the shock waves to fill an evacuated die.

Electro-hydraulic forming may be used, for example, to form a flat blank in a one-sided die. The use of EHF for a one-sided die may save tooling costs and may also facilitate forming parts into shapes that are difficult to form by conventional press forming or hydroforming techniques. Electro-hydraulic forming also facilitates forming high strength steel, aluminum and copper alloys. For example, advanced high strength steel (AHSS) and ultra high strength steel (UHSS) can be formed to a greater extent with electro-hydraulic forming techniques when compared to other conventional forming processes. Lightweight materials, such as AHSS and UHSS and high-strength aluminum alloys are lightweight materials that are used to reduce the weight of vehicles.

The use of these high strength, lightweight materials is increasing and has been proposed for hydroforming tubes. Tube hydroforming is well-known technology that is currently used in production. One problem with hydroforming tubes is that the tube tends to thin in areas that are formed to a greater extent.

The above problems are addressed by Applicant's invention as summarized below.

SUMMARY

The method and tool disclosed and claimed in this application provide increased opportunities for hydroforming parts from ductile steel and also high strength materials that have reduced formability. By applying the method, larger diameter tubular preforms can be used to form parts having smaller diameter cross-sections in localized areas. Generally, the tube blank is selected to correspond to the average perimeter of the final part. The tube blank provides material that is worked in the hydroforming process. The hydroforming process is generally used to expand the tubular blank with pressure that is exerted from the inside of the tube. With expansion hydroforming, the size of the tube is limited to the minimum perimeter of the smallest cross-section of the finished part. This limits the quantity of material that is available for the hydroforming operation and, in turn, limits the extent to which the tube can be expanded.

According to the method, a tube or tubular preform is first formed to a reduced diameter in an electro-hydraulic forming process that applies an impact force to the outer surface of the tube. The partially contracted tube is then loaded into a hydroforming tool and formed by the application of fluid pressure to the inner side of the tube to expand the tube and form the tube against the hydroforming die.

The tool that is illustrated to compress or contract the tubular preform includes two parts that together define a chamber. A portion of the tube is first encircled with a wire and then placed in the chamber. The chamber is filled with a fluid, such as water or oil, and sealed. The wire is selectively connected to a source of stored electrical energy, such as a capacitor circuit, to cause an electrical discharge in the fluid in the chamber that forms the portion of the tube radially inward to a reduced cross-sectional area. The balance of the tube may be maintained at full cross-sectional area size. The tubular preform is later formed by expanding in a hydroforming operation in the full cross-sectional area. The portion of the tube that was compressed may be expanded from the reduced cross-sectional area.

Other aspects of Applicant's concept will be better understood in view of the attached drawings and detailed description of the illustrated embodiments.

DETAILED DESCRIPTION

Figure 1:
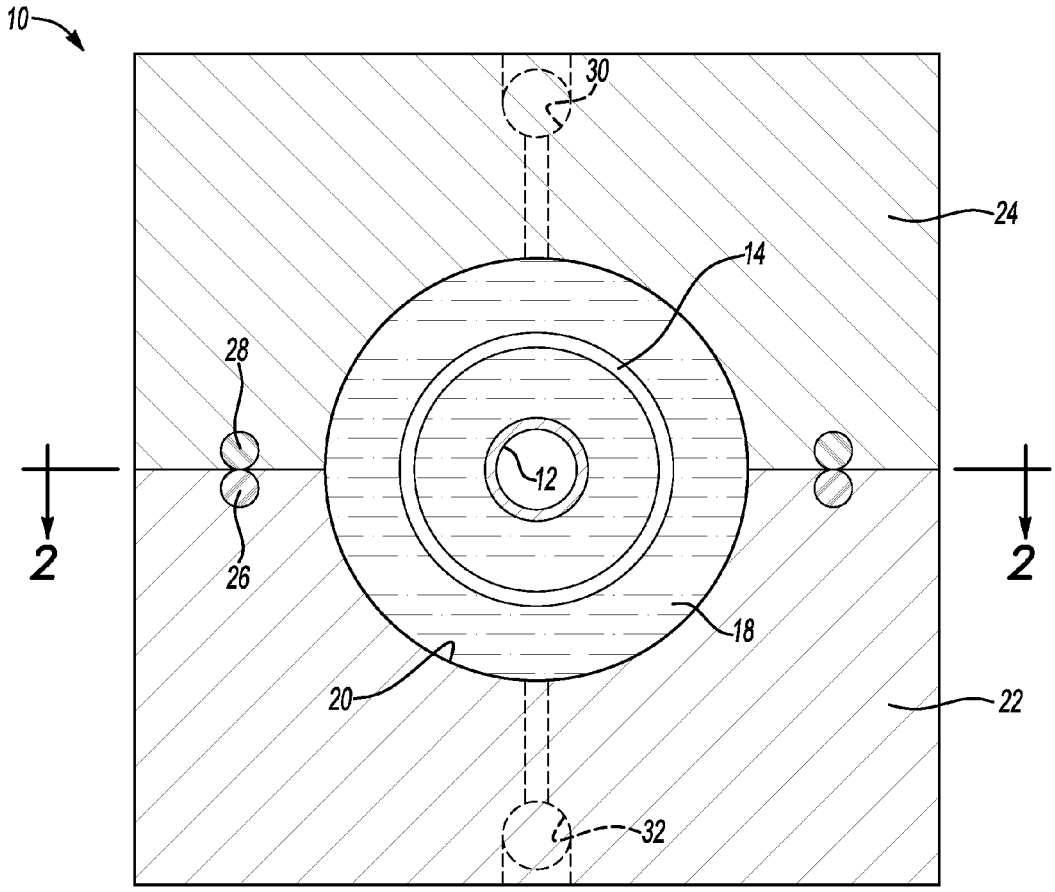
FIG. 1 is a diagrammatic cross-sectional view of an electro-hydraulic forming tool that is used to contract the diameter of a tube prior to hydroforming.

Referring to FIG. 1, an electro-hydraulic forming tool 10 is used to contract a tubular preform 12 prior to hydroforming the tubular preform is diagrammatically illustrated. A wire coil 14 is wrapped in a spaced relationship around the tubular preform 12 and submerged in a liquid 18, such as water or oil. The liquid 18 is contained within a chamber 20 defined by a first tool part 22 and a second tool part 24. The chamber 20 must be sealed, as shown by first seal 26 and second seal 28. The chamber 20 is filled by an upper port 30 and a lower port 32. It should be understood that a single fill/evacuation port could be provided instead of the two ports as illustrated.

Tubular preform 12 and wire coil 14 are preassembled and then inserted into the chamber 20 defined by the first tool part 22 and the second tool part 24. When assembled, the first seal 26 engages a second seal 28. The chamber 20 is filled through the lower port until the liquid flows out of upper port 30.

Figure 2:
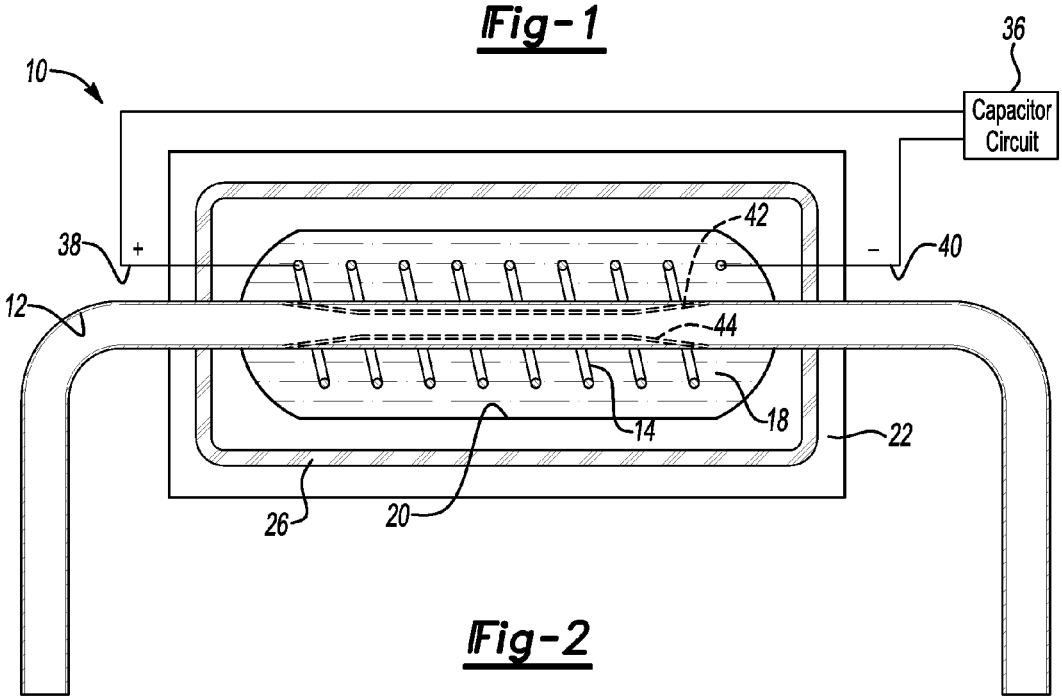
FIG. 2 is a cross-sectional view taken along the line 2-2 in FIG. 1.

Referring to FIG. 2, the electro-hydraulic forming tool 10 is shown with the second tool part 24 (shown in FIG. 1) removed. The tubular preform 12 is encircled by the wire coils 14 and immersed in the liquid 18. The first tool part 22 retains the first seal 26 to seal the chamber 20 as described with reference to FIG. 1 above. The seal 26 extends about the periphery of the forming chamber 20 and on one side of the tubular perform 12. (The seal 26 is not visible behind the tubular perform 12 as viewed in FIGS. 2-5.)

A capacitor circuit 36 that comprises a stored power source is connected to opposite ends of the wire coil 14 by a positive electrode 38 and a negative electrode 40. Alternatively, the stored power source may be an induction circuit that could be used instead of the capacitor circuit. When the capacitor circuit 36 is actuated, the wire coil 14 is energized to create a shockwave within the fluid 18 that is imparted to the tubular member 12. The tubular member in the area where the wire coil 14 encircles the tubular member is compressed from an initial tube section 42 shown in solid line to a contracted tube section 44 shown in phantom lines.

Figure 3:
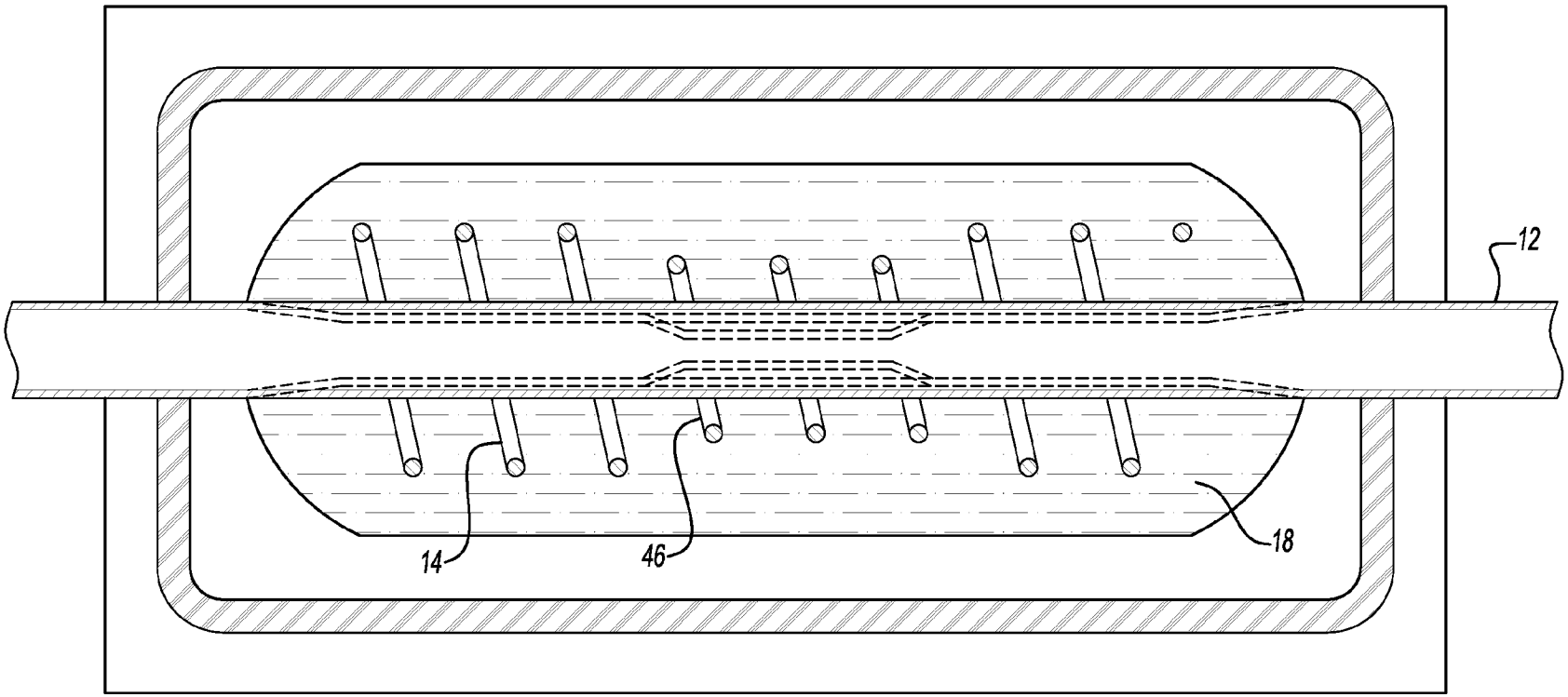
FIG. 3 is a cross-sectional view similar to FIG. 2, but showing an alternative embodiment wherein variable diameter coils are used to contract the tube to different extents along different portions of the tube.

FIG. 3 is a view similar to FIG. 2 that shows an alternative embodiment wherein reduced diameter wire loops 46 are provided as part of the wire coil 14. The tubular preform 12 is shown wrapped by the wire coil 14 including the reduced diameter wire loops 46 and is submerged in the fluid 18. The wire coil 14 is connected to a capacitor circuit, as previously described with reference to FIG. 2. When the capacitor circuit 36 is discharged, the more closely wrapped wire loops 46 are closer to the tubular preform 12 and, as a result, exert a greater contraction force on the tubular member 12. This greater contraction force compresses that portion of the tube to a greater extent compared to the contraction force applied by the other loops of the wire coil 14.

Figure 4:
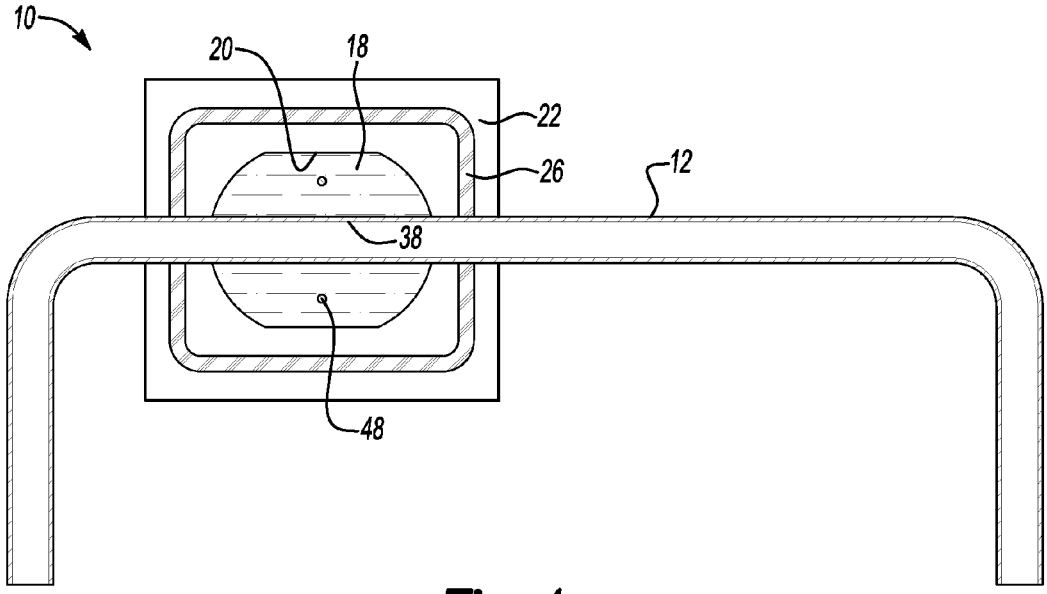
FIG. 4 is a diagrammatic cross-sectional view of an alternative embodiment of the electro-hydraulic forming tool wherein a single loop of wire is provided in the electro-hydraulic forming tool.

Referring to FIG. 4, an alternative embodiment of the electro-hydraulic forming tool is shown in which a single loop wire 48 is provided. In the embodiment shown in FIG. 4, the same reference numerals are used as previously described with reference to FIGS. 1-3. The single loop of wire 48 is wrapped in a spaced relationship around the tubular preform 12 and immersed within the liquid 18 in the chamber 20. Only one part of the chamber 20 is shown in FIG. 4 which is that part defined first tool part 22 with its associated seal 26. The second tool part 24 and the second seal 28 are also included in this embodiment, but are not illustrated to better illustrate the tool.

Figure 5:
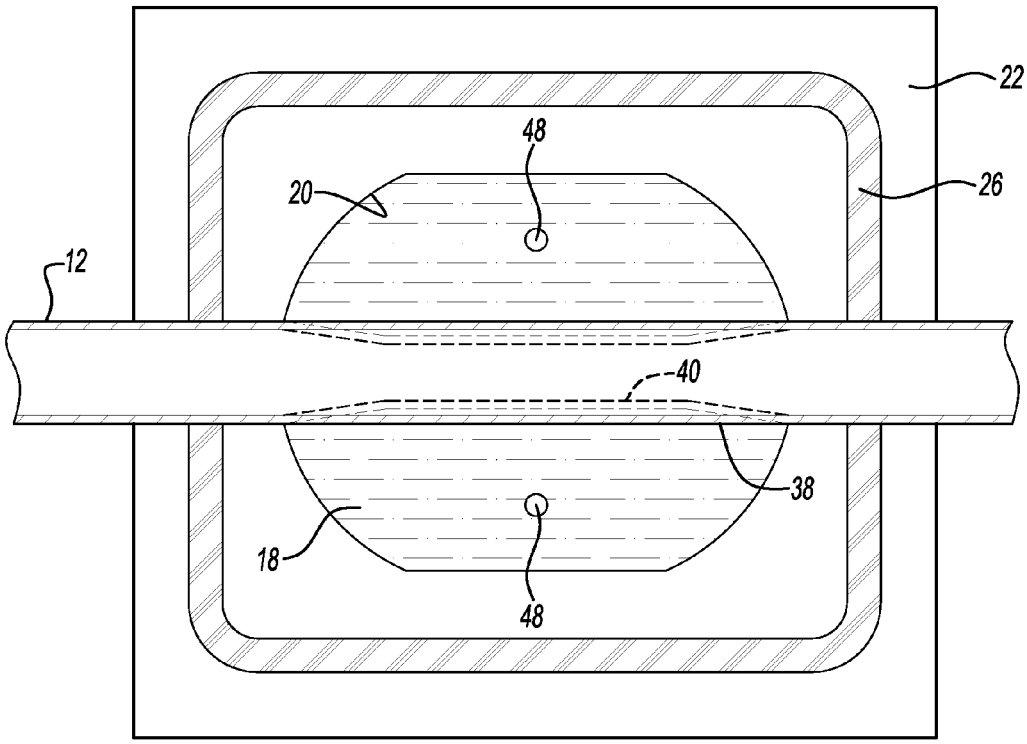
FIG. 5 is a diagrammatic cross-sectional view of a tube showing the tube before contraction and after contraction.

Referring to FIG. 5, the embodiment of FIG. 4 is shown including the tubular preform 12 with a full diameter wall section illustrated by reference numeral 38 and a contracted wall section shown in phantom lines and identified by reference numeral 40. The single loop wire 48 may be used to act on a smaller portion of the tubular member 12 than in the embodiment shown in FIGS. 1-3.

Figure 6:
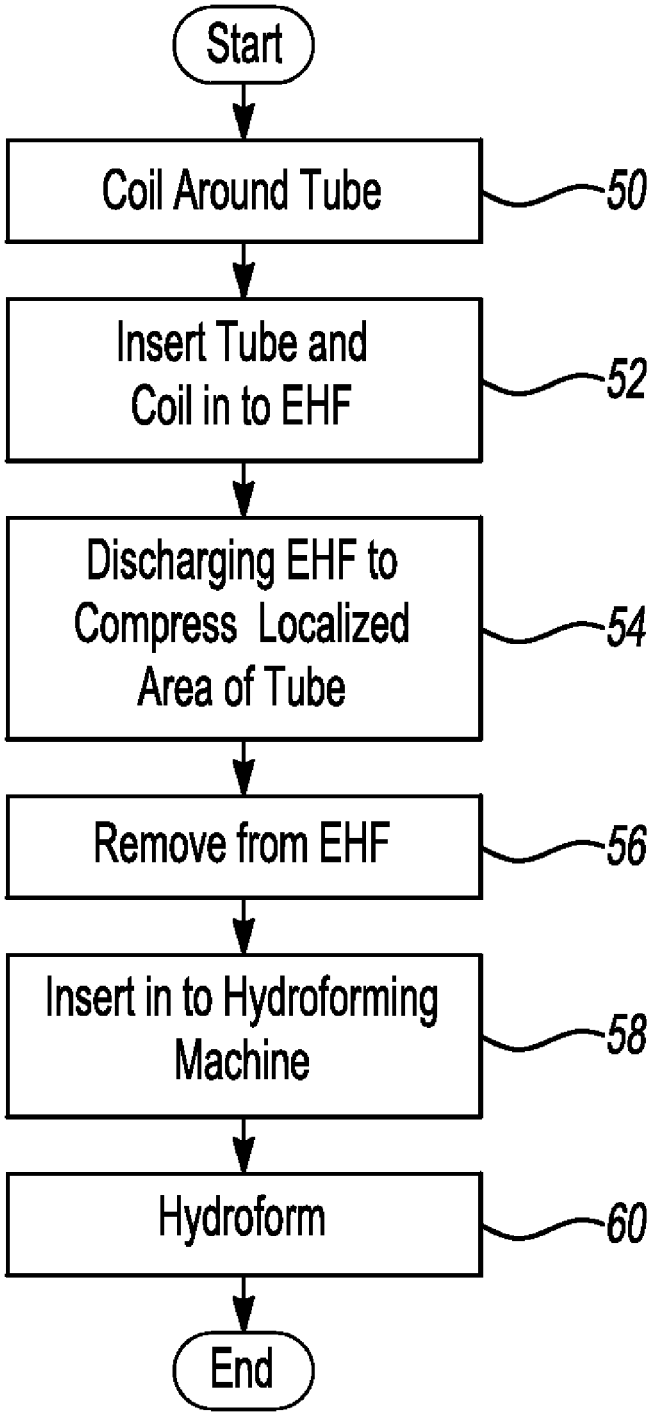
FIG. 6 is a flowchart illustrating the steps of the method of compressing a tubular preform in an electro-hydraulic forming tool prior to forming the tubular preform by expanding the tube in a hydroforming operation.

Referring to FIG. 6, a flowchart is illustrated that shows the steps of the process used to initially contract portions of a tube prior to hydroforming to expand the tube into a desired part shape. In many instances, the tube is preformed by bending to form the tube to a desired shape along its length. The first step in the process may follow the preform bending and comprises wrapping the coiled wire around the tube at 50. The coil and tube are then inserted into the electro-hydraulic forming tool at 52. The electro-hydraulic forming tool is discharged to compress a localized area of the tube at 54. The wire is destroyed by the discharge and essentially vaporizes creating a shockwave in the electro-hydraulic forming tool chamber 20 that impacts the tubular preform to compress it in a localized area. The tube may then be removed from the electro-hydraulic forming tool at 56. The tubular preform with the contracted localized area is then inserted into a hydroforming tool at 58. The hydroforming tool forms the tubular preform at 60 expanding appropriate portions of the tube including portions of the tube that were not contracted. The portions of the tube that were contracted or compressed in the electro-hydraulic forming tool may also be expanded in the hydroforming operation at 60. The tubular preform is compressed to the minimum diameter of the part to be formed.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. A method comprising:

encircling an exterior surface of a tube with at least one wire loop;

loading the tube and wire into an electro-hydraulic forming tool having a chamber that contains a liquid;

discharging a stored power source through the wire loop to create a shockwave in the liquid;

compressing the tube in a localized area with the shockwave; and hydroforming the tube by expanding the tube to form a part.

2. The method of claim 1 wherein the step of encircling the tube further comprises providing a single turn of the wire.

3. The method of claim 1 wherein the step of encircling the tube further comprises providing a plurality of turns of the wire.

4. The method of claim 1 wherein the step of discharging the stored power source further comprises actuating a capacitor circuit.

5. The method of claim 1 wherein the step of compressing the tube in a localized area further comprises compressing the tube to a uniform extent around the circumference of the tube in the localized area.

6. The method of claim 1 wherein the tube initially has an average cross-section, and wherein the cross-section of the localized area of the part is less than the average cross-section of the tube.

7. A tool for forming a tube comprising:

a first tool part that defines a first part of a chamber;

a second tool part that defines a second part of the chamber, wherein the second tool part engages the first tool part to define the chamber;

a liquid disposed in the chamber;

a single loop of wire disposed about a portion of the tube that is submerged in the liquid in the chamber;

a source of electrical energy that may be rapidly discharged through the wire; and wherein the source of electrical energy is connected to the wire to create a shockwave that compresses the portion of the tube.

8. The tool of claim 7 further comprising a seal that is provided between the first and second tool parts.

9. The tool of claim 7 wherein the chamber is cylindrical and the tube and the wire are disposed coaxially relative to each other and the cylindrical chamber.

10. A tool for forming a tube comprising:

a first tool part that defines a first part of a chamber;

a second tool part that defines a second part of the chamber, wherein the second tool part engages the first tool part to define the chamber;

a liquid disposed in the chamber;

a wire disposed about a portion of the tube that is submerged in the liquid in the chamber, wherein the wire is a coil of wire that includes a plurality of loops;

a source of electrical energy that may be rapidly discharged through the wire; and wherein the source of electrical energy is connected to the wire to create a shockwave that compresses the portion of the tube.

11. The tool of claim 10 wherein the diameter of the loops of wire are the same.

12. The tool of claim 10 wherein the diameter of the loops of wire are varied to control the intensity of the shockwave and the extent of compression of the tube.

13. A tool for forming a tube comprising:

a first tool part that defines a first part of a chamber;

a second tool part that defines a second part of the chamber, wherein the second tool part engages the first tool part to define the chamber;

a liquid disposed in the chamber;

a wire disposed about a portion of the tube that is submerged in the liquid in the chamber, wherein the wire is wound in a helical coil around the tube;

a source of electrical energy may be rapidly discharged through the wire; and wherein the source of electrical energy is connected to the wire to create a shockwave that compresses the portion of the tube.

14. A tool for forming a tube comprising:

a first tool part that defines a first part of a chamber, wherein the first tool part has a first port through which a liquid is provided to the chamber and a second port through which air is evacuated from the chamber;

a second tool part that defines a second part of the chamber, wherein the second tool part engages the first tool part to define the chamber;

a liquid disposed in the chamber:

a wire disposed about a portion of the tube that is submerged in the liquid in the chamber;

a source of electrical energy that may be rapidly discharged through the wire; and wherein the source of electrical energy is connected to the wire to create a shockwave that compresses the portion of the tube.

15. The tool of claim 14 wherein the first and second tool parts define two end openings that are provided at spaced locations and the tube is received in the openings with the portion of the tube that is submerged in the liquid being disposed between the two end openings.

* * * * *